US008827936B1

(12) United States Patent
Adaie

(10) Patent No.: US 8,827,936 B1
(45) Date of Patent: Sep. 9, 2014

(54) HAND AND FOOT MASSAGING DEVICE TO REDUCE EDEMA

(71) Applicant: Hamdah J. S. Adaie, Kuwait (KW)

(72) Inventor: Hamdah J. S. Adaie, Kuwait (KW)

( * ) Notice: Subject to any disclaimer, the term of this patent is extended or adjusted under 35 U.S.C. 154(b) by 0 days.

(21) Appl. No.: 14/187,324

(22) Filed: Feb. 24, 2014

(51) Int. Cl.
*A61H 15/00* (2006.01)
*A61H 9/00* (2006.01)

(52) U.S. Cl.
CPC ..... *A61H 9/0078* (2013.01)
USPC ..... 601/19; 601/15; 601/121; 601/134; 601/148; 607/104; 607/111

(58) Field of Classification Search
CPC ..... A61H 1/00; A61H 1/0266; A61H 1/0285; A61H 9/00; A61H 9/005; A61H 9/0078; A61H 9/0092; A61H 15/00; A61H 15/0078; A61H 15/0085; A61H 15/0092; A61H 2007/00; A61H 2007/007; A61H 2015/00; A61H 2015/0007; A61H 2015/0014; A61H 2015/0042; A61H 2001/0103; A61H 2001/0157; A61H 2001/0207; A61H 2001/0242; A61H 2001/1635; A61H 2001/5043; A61H 2001/5082; A61H 2205/065; A61H 2205/067; A61H 2205/12; A61H 2230/50; A61H 2230/505
USPC ..... 601/11, 15, 18, 19, 22, 23, 40, 61, 64, 601/75, 84, 93, 94, 96, 101, 102, 104, 105, 601/112, 118–121, 126, 127, 134, 601/148–152; 606/201; 602/13; 2/16, 20; 607/104, 111
See application file for complete search history.

(56) References Cited

U.S. PATENT DOCUMENTS

| | | | | |
|---|---|---|---|---|
| 4,762,121 | A | 8/1988 | Shienfeld | |
| 5,443,440 | A * | 8/1995 | Tumey et al. | 601/152 |
| 5,591,200 | A | 1/1997 | Cone et al. | |
| 7,238,163 | B1 * | 7/2007 | Fried et al. | 601/122 |
| 2002/0022791 | A1 * | 2/2002 | Morris et al. | 601/149 |
| 2008/0132976 | A1 * | 6/2008 | Kane et al. | 607/104 |
| 2009/0048547 | A1 * | 2/2009 | Chen | 601/15 |

* cited by examiner

*Primary Examiner* — Quang D Thanh

(57) ABSTRACT

The present invention relates a portable medical device for treating foot and hand edema. The device consists of hand and foot massaging unit, a portable waterproof electronic control unit with voice feedback and temperature control. Each of the massaging units includes internal extremity engaging elements and portions that perform the massaging activities with the glove being provided with a movable motorized pressing element that moves over the outer hand extremity, and the boat having inflatable air bags or bladders for applying massaging pressures to the foot. The boot also, include a cotton-padded rubber for comfort and the may be provides with a removable, easy to sterilize material. The control unit also provides compressed air and pressurized water or fluid through plastic delivery lines attached between the unit and the massaging units.

9 Claims, 8 Drawing Sheets

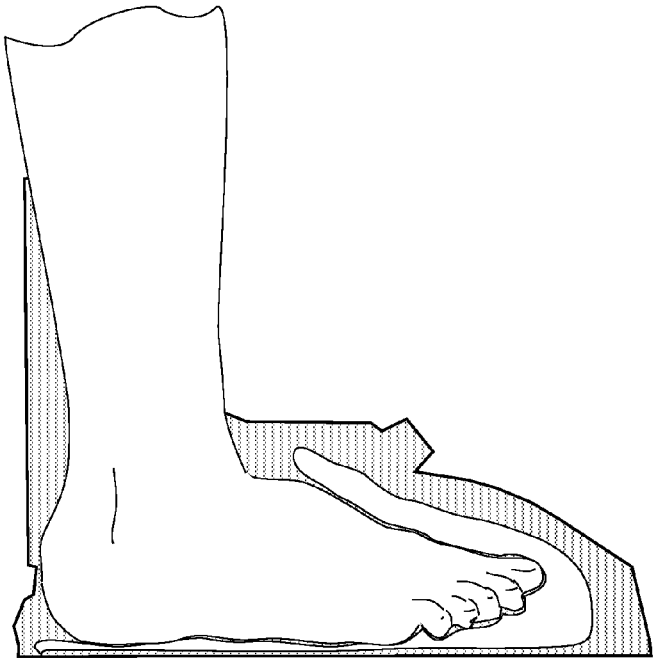
Fig - 11 - A
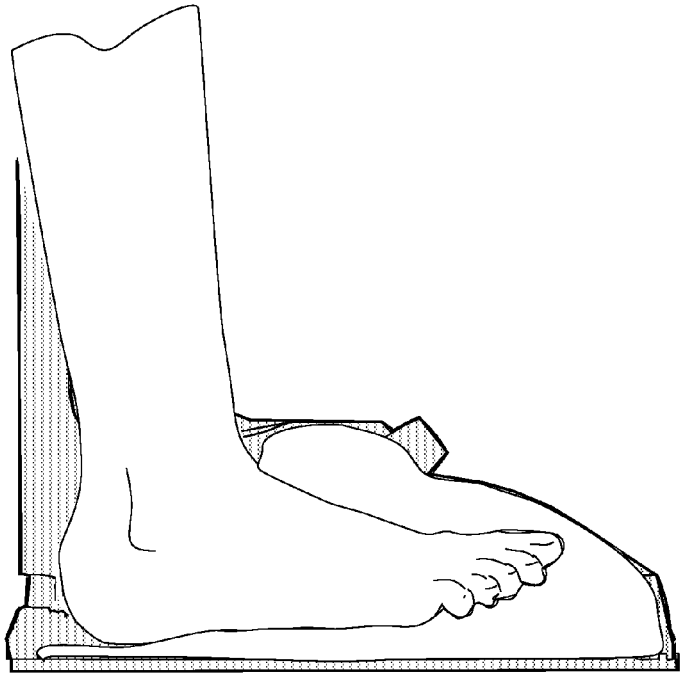
Fig - 11 - B

HAND AND FOOT MASSAGING DEVICE TO REDUCE EDEMA

BACKGROUND OF THE INVENTION

1. Field of the Invention

The present invention relates generally edema reduction and, more specifically, to such a portable device for treating foot and hand edema.

2. Description of the Related Art

Intermittent pneumatic compression is a therapeutic technique used in medical devices that include an air pump and inflatable auxiliary sleeves, gloves or boots in a system designed to improve venous circulation in the limbs of patients who suffer edema or the risk of deep vein thrombosis (DVT) or pulmonary embolism (PE). In use, an inflatable jacket (sleeve, glove or boot) encloses the limb requiring treatment, and pressure lines are connected between the jacket and the air pump. When activated, the pump fills the air chambers of the jacket in order to pressurize the tissues in the limb, thereby forcing fluids, such as blood and lymph, out of the pressurized area. A short time later, the pressure is reduced, allowing increased blood flow back into the limb. The primary functional aim of the device "is to squeeze blood from the underlying deep veins, which, assuming that the valves are competent, will be displaced proximally." When the inflatable sleeves deflate, the veins will replenish with blood. The intermittent compressions of the sleeves will ensure the movement of venous blood.

It has been recognized that swelling of limbs can be treated by applying pressure to the limb to force static fluid in the limb toward the trunk of the patient's body. For example, U.S. Pat. No. 4,762,121 ("the '121 patent") discloses a massaging sleeve that is formed with a plurality of transversely oriented cells, and an inflatable fluid bag is disposed in each of the cells. Each fluid bag includes a fluid line connector that extends through a hole formed in the associated cell, and the fluid line connectors can be connected to respective fluid lines. To treat the patient, the sleeve is wrapped around a patient's limb, and the fluid bags are then filled with fluid to compress the limb and force fluid out of the limb toward the trunk of the body. While effective for its intended purpose, the device disclosed in the '121 patent suffers from several inherent drawbacks. For instance, to facilitate removing a damaged bag and positioning a new bag in the cell, one side edge of each cell is open, but as recognized by the present invention it can be cumbersome and difficult to install a replacement fluid bag in a cell having only one open side edge. Another drawback to the '121 device is that the fluid line connectors extend outside the sleeve, and consequently can be unintentionally disengaged from their respective fluid lines by the patient during therapy. The present invention recognizes that a compression sleeve can be provided which overcomes both of these prior art problems.

U.S. Pat. No 5,591,200 related to an apparatus for treating edema by applying pressure to a patient's limb includes a sleeve that is surroundingly engageable with the limb, and the sleeve includes a plurality of flexible open-ended cells for holding respective individually inflatable replaceable bladders. Also, a fluid pump is in fluid communication with each of the bladders. The apparatus also includes a plurality of electrically-operated bladder valves, and each valve is disposed between the pump and a respective one of the bladders for selectively establishing a respective pathway for fluid communication between the pump and the associated bladder. A computer individually controls each valve to variably pressurize the bladders in a variable sequence. The computer also includes means for determining the girth of the limb being treated, and to periodically monitor the apparatus for fluid leaks.

U.S. Pat. No 5,443,440 related to a medical device is provided for applying compressive pressures against a patient's foot. The device comprises first and second panels of flexible material secured to one another to form an inflatable bag to be fitted upon the foot. The bag has first and second separate fluid bladders. The first fluid bladder is adapted to engage a first portion of the foot and the second fluid bladder is adapted to engage a second portion of the foot. A boot is provided for holding the inflatable bag to the foot. A fluid supply is provided for applying pressurized fluid to the first and second fluid bladders such that the first fluid bladder applies a first compressive pressure upon the first portion of the foot and the second fluid bladder applies a second compressive pressure upon the second portion of the foot.

Accordingly, there is a need for an improved portable lightweight medical apparatus to perform massage activities from the fingertips downward to the wrist joint easily and from the foot toes to the ankle joint and achieve optimum blood flow at an acceptable patient comfort level.

SUMMARY OF THE INVENTION

The present invention relates generally edema reduction and, more specifically, to such a portable medical device for treating foot and hand edema. The device consists of hand and foot massaging units, and a portable waterproof electronic control unit with voice feedback and temperature control.

In one aspect of the invention, the device has hand massaging unit used for treating hand edema by performing massaging activities with the glove being provided with a movable motorized pressing element that moves over the outer hand extremity. The glove may be provided with a removable, easy to sterilize material. The hand massaging unit is connected to electronic control unit through plastic fluid delivery lines which provide pressurized water or fluid to the hand messaging unit. The device starts to perform the massage activities from the fingertips downward to the wrist joint. The hand messaging unit is fitted with a comfortable armrest for the arm needed to be treated and controlled according to the needed position.

In another aspect of the invention, the device has foot massaging unit used for treating foot edema by performing massaging activities with the boot having inflatable air bags or bladders for applying massaging pressure to the foot. The boot also, includes cotton-padded rubber for comfort. The foot massaging unit is connected to electronic control unit through plastic air delivery lines which provide comprised air to the foot messaging unit. The device starts to perform the massage activities from the foot toes to the ankle joint by means of air bag pressing on the foot toes. These and other features of the present invention will become readily apparent upon further review of the following specification and drawings.

BRIEF DESCRIPTION OF THE DRAWINGS

FIG. 11*a* is perspective view showing the inflatable air bags or bladder in case of deflation.

FIG. 11*b* is perspective view showing the inflatable air bags or bladder in case of filled with pressurized air.

Similar reference characters denote corresponding features consistently throughout the attached drawings.

DETAILED DESCRIPTION OF THE PREFERRED EMBODIMENTS

The present invention relates a portable medical device for treating foot and hand edema. The device consists of hand massaging unit 200, foot massaging unit 400, and a portable waterproof electronic control unit 100 with voice feedback and temperature control.

Figure 1:
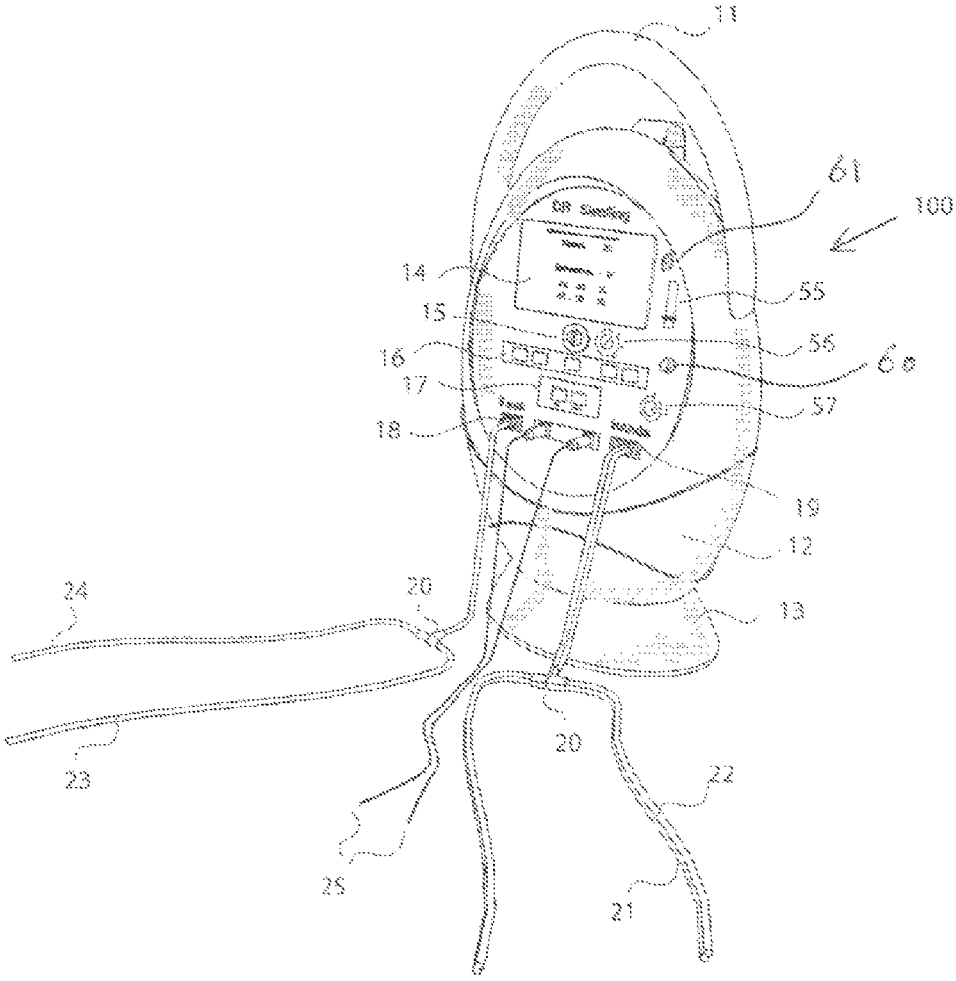
FIG. 1 is an environmental, perspective view of the electronic control unit of the device for treating foot and hand edema.
Figure 2:
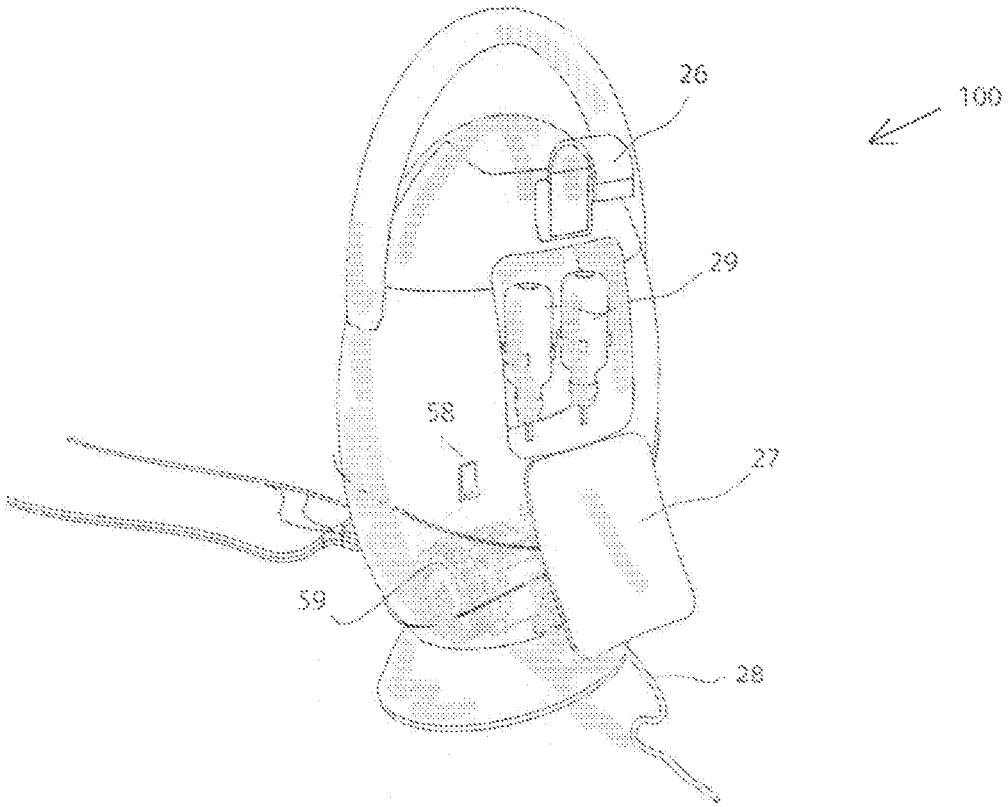
FIG. 2 is a back perspective view of the electronic control unit of the device for treating foot and hand edema.
Figure 3:
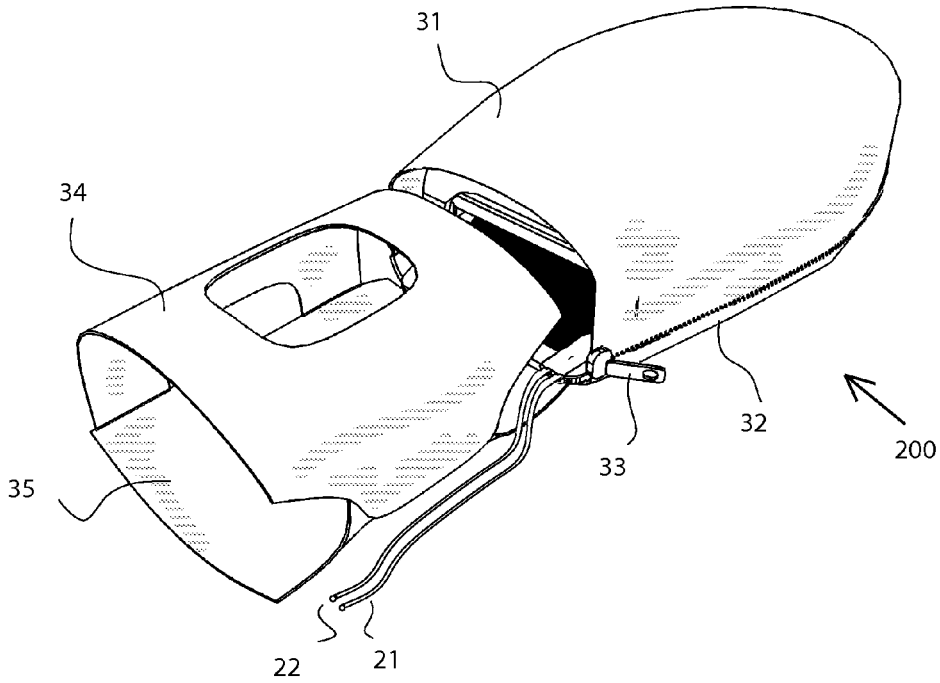
FIG. 3 is a perspective view of hand massaging unit for the device for treating foot and hand edema.
Figure 9:
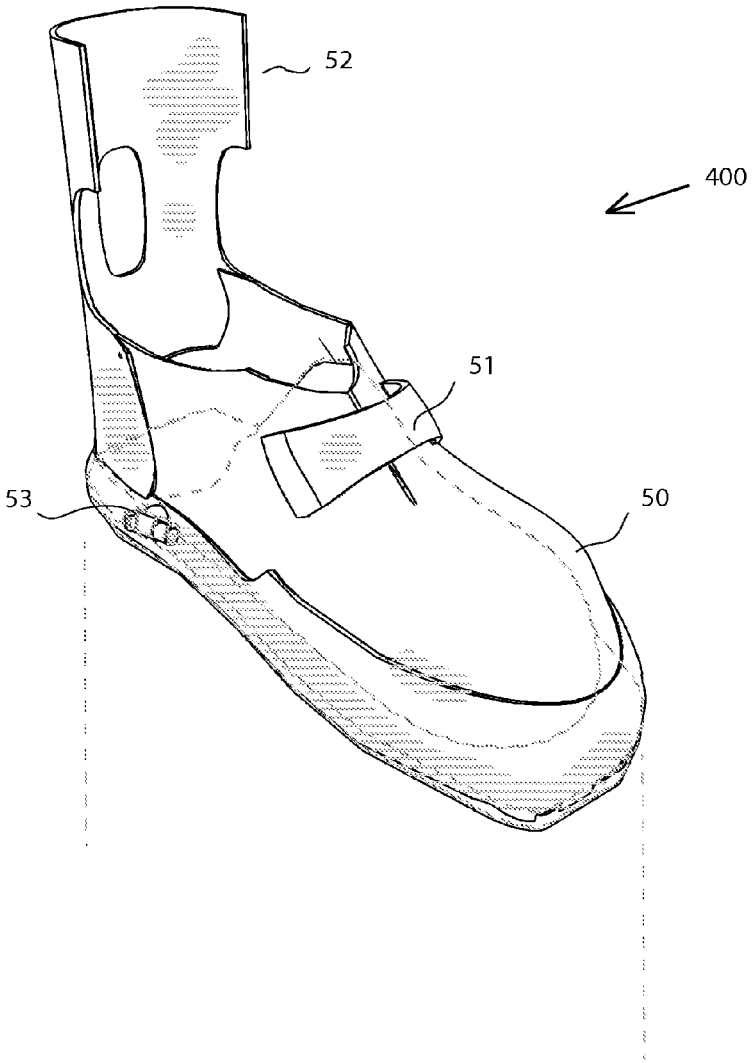
FIG. 9 is a perspective view showing the foot massaging unit.
Figure 10:
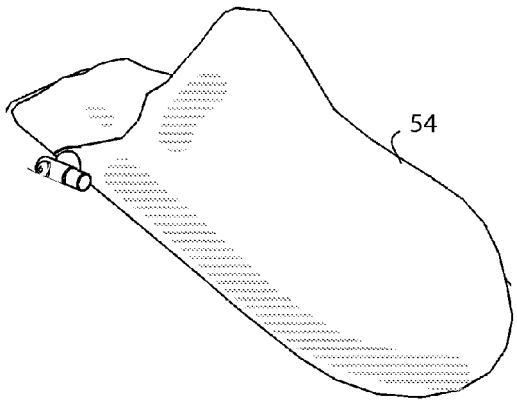
FIG. 10 is perspective view showing the inflatable air bags or bladder of the foot massaging unit.
Figure 12:
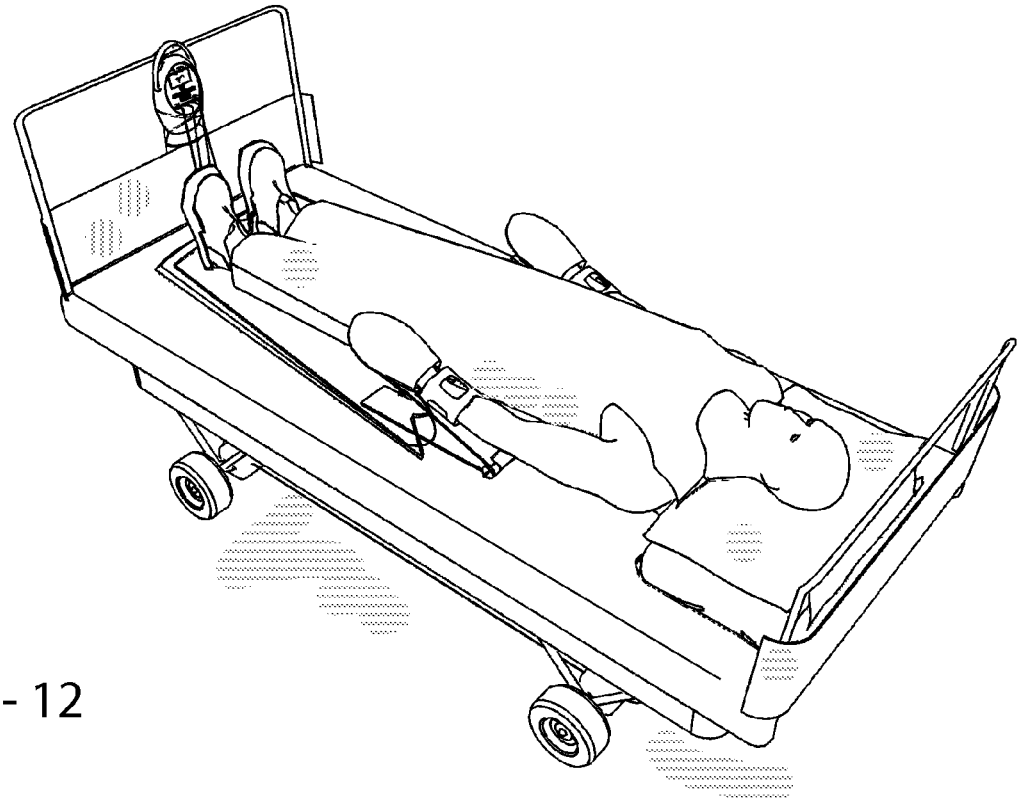
FIG. 12 is perspective view showing the user using the device of this invention.

FIGS. 1 and 2 describe of the electronic control unit 100 of the device for treating foot and hand edema. The control unit 100 consists of outer waterproof body 12 stands on the base 13 wherein the control unit 100 is hanged on patient's bed by a hook 26 or placed on a table on the base 13 and can be carried to any place by handle 11. The control units 100 also provides compressed air to foot from air slot 18 through plastic air delivery lines (24 to the left foot, and 23 to the right foot connected by T connector 20) attached between the control unit 100 and foot massaging unit 400 (FIG. 9), and provides pressurized water or fluid to hands from water or fluid slot 19 through water delivery lines (inlet pipe 21, and outlet pipe 22 to right hand to circulate the fluid and similar pipes to the left hand connected by T connector 20) attached between the control unit 100 and hand massaging unit 200 (FIG. 3).

Figure 4:
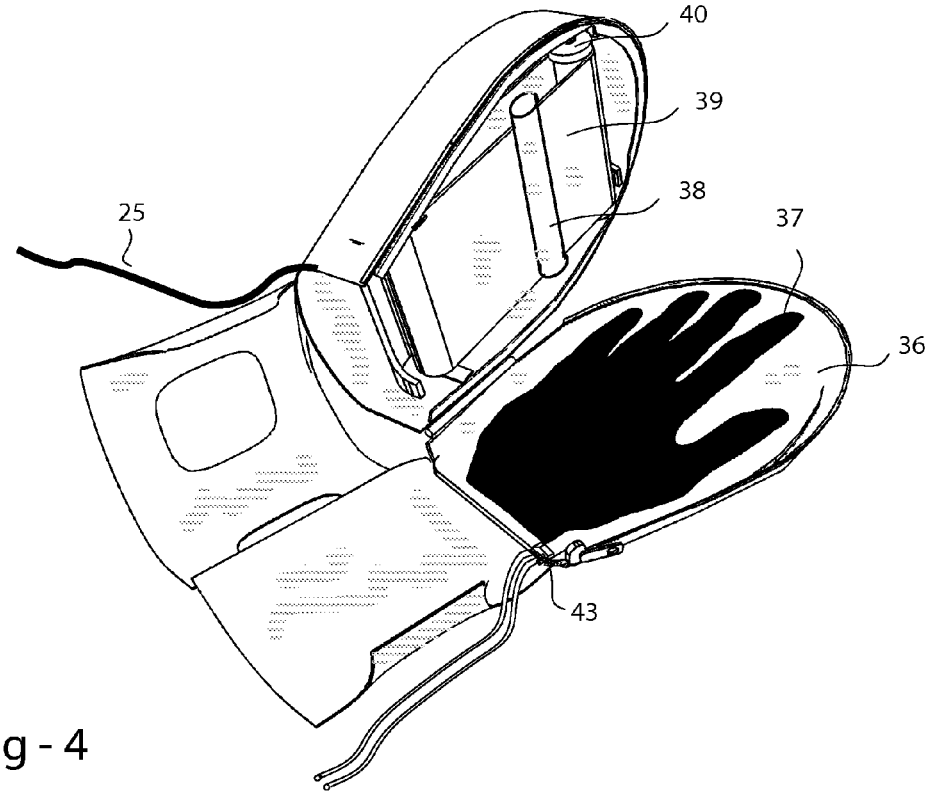
FIG. 4 is an interior detailed perspective view of hand massaging unit for the device for treating foot and hand edema.
Figure 5:
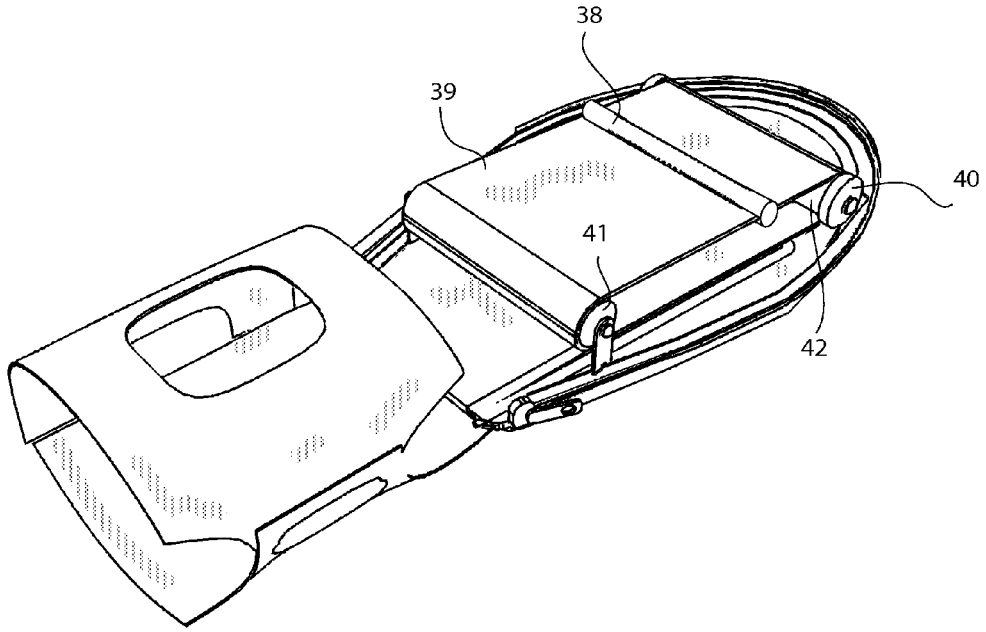
FIG. 5 is another interior detailed perspective view of hand massaging unit for the device for treating foot and hand edema showing movable motorized pressing element.

The control unit 100 has microcontroller, memory to store all data with electronic board has timer 60, fluid temperature sensor 55, and motor speed adjusting element 57, air pump 59 with air pressure controller 56, touch screen 14 to display and adjust information of the timer, temperature sensor, air pressure controller 56, and motor speed, on/off alert switch 61 to emit beep or voice indication of motor speed, controlling button board 16 which has left buttons to compress air to left and right foot, and right buttons flow water or fluid towards right and left hand, and on/off power switch 17 to initiate the DC motor 40 in the hand massaging unit 200 shown in FIG. 4 to the left and right hand through power cables 25. There is an on/off air pump power switch 58 to turn on or off the pump 59 power source.

Referring to FIG. 2, in the control unit 200 back side there is a fluid or water tanks 29 that provide the hand massaging unit 200 with water or fluid. The water or fluid tanks 29 covered by safety cover slot 27 wherein the control unit is powered through AC electric power cable 28. Also, the control unit has rechargeable battery not shown in figures to store electricity and power on the control unit 100 when cut off of electricity source.

According to FIGS. 3, 4, 5, 6, 7, 8 which describe the hand massaging unit 200 with its armrest or stand 300, the hand massaging unit 200 consists upper palm panel 31 and lower palm panels 32 secured to one another by draw slot 33 to form a glove wrist upper part panel 34 secured to wrist lower part panel 35 wherein the two lower parts of palm and wrist are attached together and the two upper parts of palm and wrist panels are separated, movable motorized pressing soft cylindrical element 38 attached with thong 39 in the upper palm panel 31 and rotate with the thong 39 over the user's outer hand extremity up to down with gravity direction to the wrist joints around two pulleys 41 and motor pulley 42 wherein the motor 40 attached to the pulley 42, and palm mold 37 housed over removable cotton-padded layer 36 in the glove lower part 32.

Figure 6:
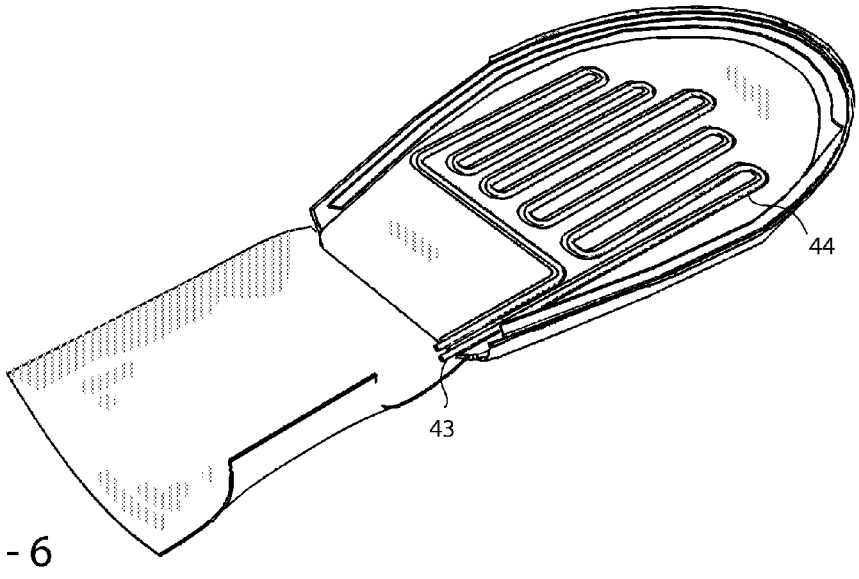
FIG. 6 is an interior detailed perspective view of hand massaging unit for the device for treating foot and hand edema shoeing the base of the massaging unit.
Figure 7:
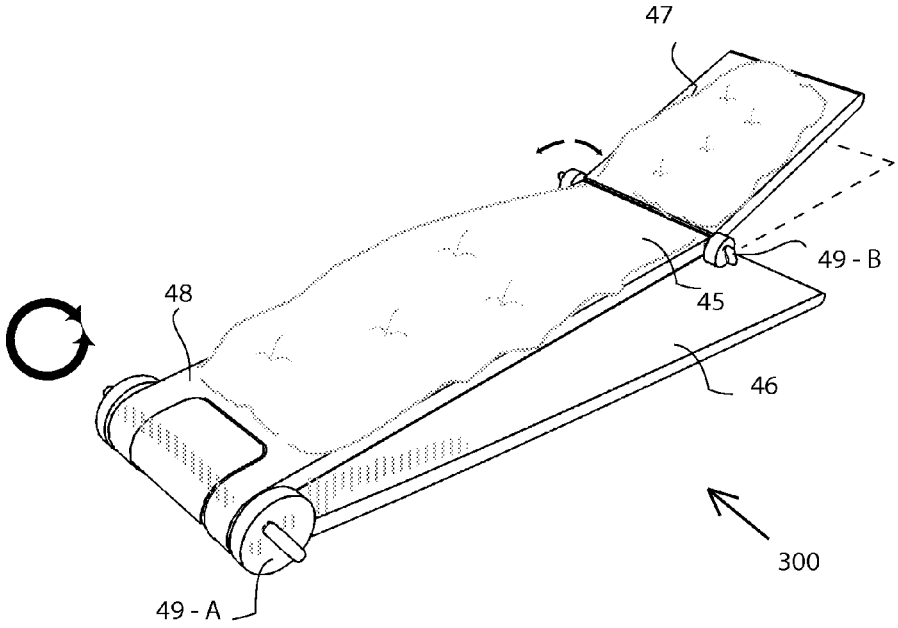
FIG. 7 is a perspective view of the adjustable armrest for the user arm.
Figure 8:
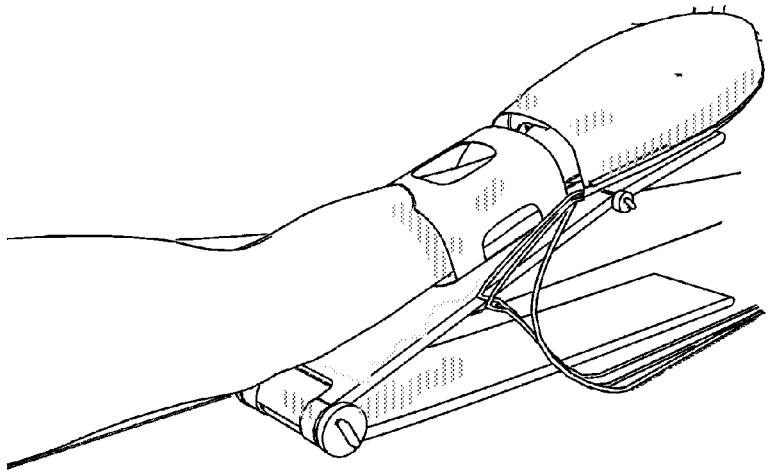
FIG. 8 is a perspective view showing the glove of the hand massaging unit when be put on the adjustable armrest.

The hand massaging unit 200 is connected with the control unit 100 through plastic delivery lines 21 and 22 through slot 43 and the fluid is circulated through the tube 44 housed under palm mold 37 to provide the user's hand with appropriate temperature according to his health condition according to FIG. 6.

To perform massaging activities to fingertips downward to the wrist joints comfortably, after the patient wears the massaging unit 200 it is fitted with a comfortable adjustable armrest or stand 300 which is adjusting according to patient health condition. The adjustable armrest 300 consists of adjustable palm stand 47 jointed with arm stand 48 which has upper comfortable layer 45 by lock 49*a*, and stand base 46 connected to the arm stand 48 by a stand ascending and descending control lock 49*b* to adjust the arm stand 48 to the appropriate position according to the patient medical state. This stand 300 enables the doctor to adjust the messaging unit 200 in a comfortable position according to patient medical state according to FIGS. 7, 8.

Foot massaging unit 400 according to FIGS. 9, 10, 11*a* and 11*b* is connected to control unit 100 by air delivery lines 23 and 24 through slot 18 in control unit 100 and air pressure slot 53 attached to the inflatable air bags or bladders 54. The massaging unit 400 comprises of such elements secured together to form an inflatable boot or bag, these elements are outer boot body 50 attach to leg holder 52 to fix the foot straight, boot fastener 51 to fasten the boot outer body 50 after inflate the bladder 54 which housed inside the boot 50. After the patient wear the boot, the doctor adapts air pressure from control unit 100, so the air pass through the air delivery line 23 and 24 to the bladder 54 to fill it with air around the patient foot to circulate and replenish the foot blood and perform a massaging activities. The boot 50 includes cotton-padded rubber for comfort.

The doctor can adjust the period for flowing air and water to foot massaging unit 400 and to hand massaging unit 200 respectively and the motor 40 speed to perform massaging activities to foot and hand according the medical state of the patient. The flow of air and water to the foot and the hand circulate and replenish the blood of patient so this device can treat foot and hand edema easily.

The device of this invention can be placed on a table, hanged up in patient's bed, and portable to any place. The device is made of light-weight material so we can easily to carry it to any place. The device may connected to smart phone device by Bluetooth or Wi-Fi connection and can be controlled by doctor smart phone remotely by application store in the smart phone to adjust the timer, temperature, motor speed and air pressure.

It is to be understood that the present invention is not limited to the embodiments described above, but encompasses any and all embodiments within the scope of the following claims

The invention claimed is:

1. A portable medical device for treating foot and hand edema comprising:

a hand massaging unit having internal extremity engaging elements and portions to perform massaging activities to a user's hand, wherein said hand massaging unit further having an upper palm panel and an lower palm panel secured to one another by draw slot to form a glove provided with a movable motorized pressing element moves up to down over the user's outer hand extremity;

a foot massaging unit having inflatable air bags or bladders for applying massaging pressures to the user's foot; and a portable waterproof electronic control unit with voice feedback; wherein said portable waterproof electronic control unit having an outer waterproof body stands on a base, a hook attached to an upper rear part of the outer water proof body for hanging the control unit on the user's bed, a handle attached to an upper part of the outer body for carrying the control unit, plastic air delivery lines to the left foot and to the right foot divided through T-shaped tube connector wherein the two plastic delivery lines attached to control unit through an air slot housed in a front side of the control unit to connect the control unit with said foot massaging unit providing compressed air to the user's foot, fluid delivery lines attached to said control unit through a fluid slot housed in the front side of said control unit to connect said control unit with said hand massaging unit providing pressurized fluid to the user's hand from fluid tanks housed inside the control unit, a fluid temperature sensor housed in the front side of the control unit, a motor speed adjusting element housed in the front side of the control unit wherein the said motor speed adjusting element adjusting a speed of a motor housed inside said hand massaging unit, a timer housed in the front side of the control unit, an air pump housed inside the control unit wherein the air pump controlled by air pressure controller housed in the front side of the control unit, a touch screen housed in the front side of the control unit to display and adjust information of the timer, the temperature sensor, the air pressure controller, and the motor speed, an on/off alert switch housed in the front side of the control unit to emit beep or voice indication of the motor speed, a controlling button board housed in the front side of the control unit wherein said controlling button board having left buttons to compress air to the left and right feet and right buttons pressurized fluid towards right and left hands, and an electric power cable providing electric power to the control unit.

2. The portable medical device for treating foot and hand edema according to claim 1, wherein said fluid delivery lines having two lines for each hand to circulate the fluid and divided by T-shaped connector to connect both hands.

3. The portable medical device for treating foot and hand edema according to claim 1, wherein said hand massaging unit further comprising:

a wrist upper part panel secured attached to a wrist lower part panel element wherein the two lower palm panel with the wrist lower part panel are attached together and the two upper palm panel with the wrist upper part panel are separated;

said movable motorized pressing element comprising a soft cylindrical element attached with a thong housed in the upper palm panel, wherein said movable motorized pressing soft cylindrical element and the thong are rotated together over the user's outer hand extremity up to down towards the user's wrist around two pulleys;

a DC motor attached to one pulley;

a palm mold housed over a removable cotton-padded layer in the lower palm panel;

a fluid slot housed in the lower palm panel to connect said fluid delivery lines delivering fluid between the hand massaging unit and said control unit; and a fluid tube housed under the palm mold attached to said fluid slot to circulate fluid under the user's palm.

4. The portable medical device for treating foot and hand edema according to claim 1, further comprising a comfortable adjustable armrest to carry said hand massaging unit while performing massage to the user, wherein said adjustable armrest comprising:

an adjustable palm stand attached to an arm stand by a lock; and a stand base connected to the arm stand by a stand ascending and descending control lock to adjust the arm stand to the appropriate position; wherein the arm stand includes an upper comfortable layer.

5. The portable medical device for treating foot and hand edema according to claim 1, wherein said foot massaging unit having elements secured together to form an inflatable boot, the boot comprising:

an outer boot body attached to a leg holder for fixing the user's foot straight; and a boot fastener for fastening the outer boot body after inflating the bladder, wherein the bladder housed inside the outer boot body and the bladder attached to said control unit through said air delivery line to the bladder to fill the bladder with air.

6. The portable medical device for treating foot and hand edema according to claim 5, wherein the inflatable boot having a cotton-padded rubber for comfort.

7. A portable medical device for treating hand edema comprising:

a portable waterproof electronic control unit with voice feedback;

a hand massaging unit having internal extremity engaging elements and portions to perform massaging activities to a user's hand, provided with a movable motorized pressing element moves up to down over the user's outer hand extremity, wherein the hand massaging unit comprising: an upper palm panel and a lower palm panel secured to one another by draw slot to form a glove; a wrist upper part panel secured to a wrist lower part panel, wherein the two lower palm panel with the wrist lower part panel are attached together and the two upper palm panel with the wrist upper part panel are separated; said movable motorized pressing element comprising a soft cylindrical element attached with a thong housed in the upper palm panel, wherein said movable motorized pressing soft cylindrical element and the thong are rotated together over the user's outer hand extremity up to down towards the user's wrist around two pulleys;

a DC motor attached to one pulley;

a palm mold housed over a removable cotton-padded layer in the lower palm panel;

a fluid slot housed in the lower palm panel to connect said fluid delivery lines delivering fluid between the hand massaging unit and said control unit; and a fluid tube housed under the palm mold attached to said fluid slot to circulate fluid under the user's palm.

8. The portable medical device for treating hand edema according to claim 7, wherein the control unit comprising:

an outer waterproof body stands on a base;

a hook attached to an upper rear part of the outer water proof body for hanging the control unit on the user's bed;

a handle attached to an upper part of the outer body for carrying the control unit;

fluid delivery lines attached to said control unit through a fluid slot housed in a front side of said control unit to connect said control unit with said hand massaging unit providing pressurized fluid to the user's hand from fluid tanks housed inside the control unit;

a fluid temperature sensor housed in the front side of the control unit;

a motor speed adjusting element housed in the front side of the control unit wherein the said motor speed adjusting element adjusting a speed of a motor housed inside said hand massaging unit;

a timer housed in the front side of the control unit;

an air pump housed inside the control unit wherein the air pump controlled by air pressure controller housed in the front side of the control unit;

a touch screen housed in the front side of the control unit to display and adjust information of the timer, the temperature sensor, the air pressure controller, and the motor speed;

an on/off alert switch housed in the front side of the control unit to emit beep or voice indication of the motor speed;

a controlling button board housed in the front side of the control unit, wherein said controlling button board having left buttons to compress air to the left and right feet and right buttons pressurized fluid towards right and left hands; and an electric power cable providing electric power to the control unit.

9. The portable medical device for treating hand edema according to claim 7, further comprising a comfortable adjustable armrest to carry said hand massaging unit while performing massage to the user, wherein said adjustable armrest comprising: an adjustable palm stand attached to an arm stand by a lock; and a stand base connected to the arm stand by a stand ascending and descending control lock to adjust the arm stand to the appropriate position; wherein the arm stand includes an upper comfortable layer.

* * * * *